US006122467A

United States Patent [19]

Ehara et al.

[11] Patent Number: 6,122,467

[45] Date of Patent: Sep. 19, 2000

[54] IMAGE FORMING APPARATUS USING AN AMORPHOUS SILICON PHOTOSENSITIVE MEMBER HAVING A THIN CYLINDER

[75] Inventors: Toshiyuki Ehara; Yuji Nakayama, both of Yokohama; Masaya Kawada, Nara; Hironori Owaki, Mishima, all of Japan

[73] Assignee: Canon Kabushiki Kaisha, Tokyo, Japan

[21] Appl. No.: 09/310,986

[22] Filed: May 13, 1999

[30] Foreign Application Priority Data

May 14, 1998 [JP] Japan ..... 10-132245
May 15, 1998 [JP] Japan ..... 10-133900

[51] Int. Cl.[7] ..... G03G 15/00

[52] U.S. Cl. ..... 399/159; 399/174; 430/56

[58] Field of Search ..... 399/159, 161, 399/174, 175, 176, 168; 430/56, 57, 69, 84, 85, 902

[56] References Cited

U.S. PATENT DOCUMENTS

| | | | |
|---|---|---|---|
| 4,461,820 | 7/1984 | Shirai | 430/65 |
| 5,112,709 | 5/1992 | Yamazaki et al. | 430/46 |
| 5,191,381 | 3/1993 | Yuan | 399/90 |
| 5,392,098 | 2/1995 | Ehara et al. | 399/159 |
| 5,592,274 | 1/1997 | Higashi et al. | 399/174 X |
| 5,729,800 | 3/1998 | Ohba et al. | 399/159 |
| 5,923,925 | 7/1999 | Nakamura et al. | 399/159 X |
| 5,943,531 | 8/1999 | Takai et al. | 399/159 |

FOREIGN PATENT DOCUMENTS

| | | |
|---|---|---|
| 136902 | 4/1985 | European Pat. Off. . |
| 2746967 | 4/1979 | Germany . |
| 2855718 | 6/1979 | Germany . |
| 53-031242 | 3/1978 | Japan . |
| 55-40161 | 10/1980 | Japan . |
| 1-238677 | 9/1989 | Japan . |
| 8-15882 | 1/1996 | Japan . |
| 9-120193 | 5/1997 | Japan . |
| 2102028 | 1/1983 | United Kingdom . |

OTHER PUBLICATIONS

Derwent Abstract JP 02–251,866 (1990).
Derwent Abstract JP 62–175,781 (1987).
Patent Abstracts of Japan JP 63–210,864 (1988).
Derwent Abstract JP 63–121,851.
Derwent Abstract JP 63–91,664 (1988).

*Primary Examiner*—Sophia S. Chen
*Attorney, Agent, or Firm*—Fitzpatrick, Cella. Harper & Scinto

[57] ABSTRACT

In order to reduce the cost of a photosensitive member and to prevent the fluctuation in image density and the image smear by highly precise temperature control, the image forming apparatus of the present invention includes: a cylindrical photosensitive member with a conductive substrate having a thickness not smaller than 0.1 mm and smaller than 2.5 mm, and a light-receiving layer having a photoconductive layer on the conductive substrate, the light-receiving layer containing at least amorphous silicon; and a charging device for charging the photosensitive member, wherein the photoconductive layer has a thickness not smaller than 5 $\mu$m and smaller than 20 $\mu$m, and wherein the charging device is a device for contacting a charging member with the surface of the photosensitive member and applying a voltage to the charging member to charge the photosensitive member.

26 Claims, 8 Drawing Sheets

IMAGE FORMING APPARATUS USING AN AMORPHOUS SILICON PHOTOSENSITIVE MEMBER HAVING A THIN CYLINDER

BACKGROUND OF THE INVENTION

1. Field of the Invention

The present invention relates to an image forming apparatus using an amorphous silicon (hereinafter represented as "a-Si") photosensitive member utilizing electrophotographic system, and more specifically to an image forming apparatus including an electrophotographic apparatus employing a low cost photosensitive member comprising a cylinder with a small thickness.

2. Related Background Art

The photoconductive material constituting the photoconductive layer in the image forming member for electrophotography is required, in the image formation field, to satisfy various characteristics such as a high sensitivity, a high S/N ratio (photocurrent (Ip)/(Id)), spectral absorption characteristics matching the spectral characteristics of the irradiating electromagnetic wave (light in wide sense including ultraviolet light, visible light, infrared light, X-ray, gamma-ray, etc.), a high-speed light response, a desired dark resistance and no pollution to the human body at use. The above-mentioned pollution-free property at use is particularly important in the case of the electrophotographic image forming member incorporated in the electrophotographic apparatus to be used as an office equipment in the office.

Based on the above standpoints, amorphous silicon of which dangling bonds are bonded with monovalent elements such as hydrogen atoms (H) or halogen atoms (X) (hereinafter represented as "a-Si(H, X)") is described as to application to the electrophotographic image forming member, for example in the German Patent Application Laid-open Nos. 2746967 and 2855718, and is already utilized in the electrophotographic image forming member because it has excellent photoconductivity, abrasion resistance and heat resistance, and it is relatively easily formed with a large area.

In the case of forming an electrophotographic photosensitive drum with a photoconductive material containing a-Si(H, X), in order to obtain satisfactory photoconductive characteristics, there is generally employed a method of continuously heating a drum-shaped metal substrate, in an a-Si(H, X) film deposition apparatus, at a temperature of 200° C. to 350° C. which is extremely higher than that in the case of a selenium-based drum, and depositing an a-Si(H, X) film with a thickness of 1 to 100 $\mu$m on the drum-shaped metal substrate. Such continued heating of the substrate at the high temperature is essential for obtaining the a-Si based photosensitive drum with excellent electrophotographic characteristics, and currently requires several hours to ten and several hours in consideration of the deposition rate of the a-Si(H, X) film.

In a preferred embodiment, the electrophotographic photoconductive member is composed of a drum-shaped or cylindrical metal substrate composed of Al or an Al alloy (hereinafter referred to as Al-based substrate) constituting the metal support member for the electrophotographic photoconductive member, and a photoconductive layer formed on the drum-shaped Al-based metal substrate and having an amorphous material containing silicon atoms as a matrix and preferably at least one kind of hydrogen atoms and halogen atoms. The photoconductive layer may also be provided with a barrier layer in contact with the drum-shaped metal substrate and further a surface barrier layer on the surface of the photoconductive layer.

FIGS. 1A and 1B are views showing an example of the structure of the a-Si photosensitive member. FIG. 1A is a schematic perspective view of the photosensitive member, wherein reference numeral 2100 indicates the thickness of the photosensitive member including a substrate 2101 and a light-receiving layer 2103. FIG. 1B is a schematic cross-sectional view of the photosensitive member. The photosensitive member includes a conductive substrate 2101 and a series of deposited sublayers constituting a light receiving layer 2105. On a conductive substrate 2101 such as of aluminum, there are successively deposited a charge injection inhibition layer 2102 for inhibiting charge injection from the conductive substrate 2101, and a photoconductive layer 2103 for generating electrons and positive holes by light irradiation and converting image information into potential information. Each of these layers is composed of amorphous silicon as a matrix and, if necessary, further contains a dangling bond neutralizing agent such as halogen atoms or hydrogen atoms, a valence electron controlling agent such as an element of the group III or V of the periodic table, a modifying material such as oxygen, carbon or nitrogen atoms. On the upper surface of the photoconductive layer 2103 as shown in FIG. 1B, there is provided a surface protective layer 2104 for protecting the photoconductive layer from the abrasion by a developer, a transfer paper and a cleaning device and for inhibiting the charge injection from the surface into the photoconductive layer. The surface protective layer 2104 is composed of a-SiC:H which is excellent in light transmission to the photoconductive layer, mechanical strength and prevention of charge injection from above.

The material constituting the drum-shaped metal substrate is preferably composed of, for example a metal such as NiCr, stainless steel, Al, Cr, Mo, Au, Nb, Ta, V, Ti, Pt or Pd, or an alloy thereof, and particularly Al or an Al-based alloy is preferably used.

As the material of the drum-shaped substrate, aluminum or aluminum-based alloy is preferred because satisfactory dimensional precision, for example in circularity or surface smoothness can be obtained relatively easily, also because the temperature control is relatively easy in the surface portion of the deposition of a-Si(H, X) at the manufacturing process and furthermore because such material is economical.

The halogen atoms (X) that can be contained in the photoconductive layer of the photoconductive member include fluorine, chlorine, bromine and iodine, but preferred is chlorine and particularly fluorine. In addition to the silicon, hydrogen and halogen atoms, the photoconductive layer may further contain, as the aforementioned valence electron controlling material or modifying material, a component for regulating the Fermi level or the bandgap such as atoms belonging to the group III of the periodic table such as boron or gallium atoms (hereinafter referred to as "group III atoms"), atoms belonging to the group V of the periodic table such as nitrogen, phosphor or arsine atoms (hereinafter referred to as "group V atoms"), oxygen atoms, carbon atoms, germanium atoms, alone or in suitable combination.

The barrier layer is provided for improving the adhesion between the photoconductive layer and the drum-shaped metal substrate or adjusting the charge receiving ability. The barrier layer is constructed with a single- or multi-layered structure composed of an a-Si(H, X) layer or a polycrystalline Si layer containing the group III atoms, group V atoms, oxygen atoms, carbon atoms, germanium atoms etc. according to the purpose.

On the photoconductive layer, there may be provided a surface charge injection inhibition layer or a protective layer consisting of an amorphous material containing silicon atoms as a matrix and carbon, nitrogen, oxygen atoms, etc. preferably in a large amount and, if necessary, further containing hydrogen or halogen atoms, or consisting of an organic substance with a high electric resistance.

The photoconductive layer composed of a-Si(H, X) can be formed with conventional various vacuum deposition methods utilizing electric discharge phenomena such as a glow discharge method, a sputtering method or an ion plating method.

In the following there will be explained an example of the method of producing the electrophotographic photoconductive member (photosensitive member) by the glow discharge decomposition method.

FIG. 2 shows an example of the apparatus for producing the electrophotographic photosensitive member by the glow discharge deposition method. A deposition chamber 1 is composed of a base plate 2, a wall 3 and a top plate 4. In the deposition chamber 1, there is provided a cylindrical cathode electrode 5, and a drum-shaped metal substrate 6 on which the a-Si(H, X) film is to be deposited. The substrate 6 is positioned at the central portion (concentric center) of the cathode electrode 5 and also functions as an anode electrode.

In order to form the deposited a-Si(H, X) film on the drum-shaped metal substrate in the above apparatus, a raw material gas introduction valve 7 and a leak valve 8 are at first closed, and a discharge valve 9 is opened to evacuate the interior of the deposition chamber 1. When a vacuum gauge 10 indicates about $5\times10^{-6}$ Torr, the raw material gas introduction valve 7 is opened to introduce, into the deposition chamber 1, mixed raw material gases such as $SiH_4$, $Si_2H_6$, $SiF_4$, etc. adjusted at a previously predetermined ratio in a mass flow controller 11. The opening degree of the discharge valve 9 is adjusted under the observation of the reading of the vacuum gauge 10, so as to maintain the pressure in the deposition chamber 1 at a predetermined value. Then, after confirmation that the surface temperature of the drum-shaped metal substrate 6 is set at a predetermined value by a heater 12, a high frequency power source 13 is activated at a desired power to generate glow discharge in the deposition chamber 1.

During the layer formation, the drum-shaped metal substrate 6 is rotated at a constant speed by a motor (M) 14, in order to achieve uniform layer formation. Thus an a-Si(H, X) deposition film can be formed on the drum-shaped metal substrate 6.

However, the deposited a-Si(H, X) film often peels off from the drum-shaped metal substrate not only during the film deposition in which the drum-shaped metal substrate is maintained at a high temperature but also during the cooling to the atmospheric temperature after the film deposition, because of a difference in the thermal expansion coefficient between the drum-shaped metal substrate and the a-Si(H, X) film and also because of a large internal stress in the formed a-Si(H, X) film. Besides, the peeling of the a-Si(H, X) film is often observed in the course of use as the electrophotographic photosensitive drum, by the heating of the drum depending on the ambient temperature in the use. Such peeling of the a-Si(H, X) film tends to occur more easily with an increase in the thickness thereof, and is also caused in the case of the a-Si(H, X)-based photosensitive drum. By a thermal deformation of the drum-shaped metal substrate (in particular, easily during the formation of the photoconductive layer) at a level not inducing the film peeling in the conventional Se-based photosensitive drum, the film peeling often generates in the a-Si(H, X)-based photosensitive drum because of the difference in the thermal expansion coefficient as mentioned above and the large internal stress of the a-Si(H, X) film. The internal stress of the a-Si(H, X) film can be relaxed to a certain extent by the producing conditions of the a-Si(H, X) film (such as the kind of the raw material gasses, gas flow rate ratio, discharge power, substrate temperature, internal structure of the producing apparatus, etc.), but such relaxation is still insufficient in consideration of the productivity and mass production efficiency. The film peeling is fatal, inducing an image defect in the use of the electrophotographic photosensitive drum.

Also the heating of the drum-shaped metal substrate at the high temperature for a long time in the production of the a-Si(H, X) film not only induces the film peeling as mentioned above but also tends to cause thermal deformation of the drum-shaped metal substrate. This thermal deformation causes uneven discharge in the production of the a-Si(H, X) film, thereby degrading the uniformity of the deposited film and resulting in an image defect.

In consideration of the foregoing, there is already proposed, as disclosed for example in the Japanese Patent Publication No. 6-14189, an electrophotographic photoconductive member capable of reducing the image defect by employing a drum-shaped metal substrate composed of aluminum or an aluminum alloy having a thickness of at least 2.5 mm.

However, in consideration of the recent fierce price competition in the copying machine market spreading particularly in the middle- and low-speed machine area, a lower running cost alone is insufficient and the realization of a lower initial cost is an important point. For this reason, it is urgently desired to reduce the cost of the substrate and significantly reduce the cost of the photoconductive member.

Within the cost of the photoconductive member, the raw material cost has a large proportion, and a reduction in the thickness of the drum-shaped metal substrate is anticipated not only to simply reduce the raw material cost but also, because of a low heat capacity resulting from the smaller thickness, to achieve various cost reduction effects such as electric power saving and a shorter tact time based on a shorter heating time, a reduction in the electric power required for maintaining the high temperature, and a reduction in the tact time based on a reduced cooling time in the production of the a-Si(H, X) film. For these reasons, there have been desired a lower cost of the drum-shaped metal substrate and an improvement in the temperature characteristics thereof.

SUMMARY OF THE INVENTION

In consideration of the foregoing, an object of the present invention is to provide an image forming apparatus capable of stably providing a high quality image with improved temperature characteristics and a lower cost.

Another object of the present invention is to provide an image forming apparatus capable of achieving electric power saving, shorter tact time and a lower cost in the production of the electrophotographic photosensitive member.

Still another object of the present invention is to provide an image forming apparatus at a low cost, by which a high quality image can be obtained with little image defects such as white spots resulting from peeling of the deposited a-Si(H, X) film.

Still another object of the present invention is to provide an image forming apparatus employing an electrophotographic photoconductive member always having stable electrical, optical and photoconductive characteristics, and excellent durability without from degradation in the repeated use.

Still another object of the present invention is to provide an image forming apparatus comprising: a cylindrical photosensitive member comprising a conductive substrate having a thickness not smaller than 0.1 mm and smaller than 2.5 mm, and a light-receiving layer having a photoconductive layer on the conductive substrate and containing at least amorphous silicon; and a charging device for charging the photosensitive member, wherein the thickness of the photoconductive layer is not smaller than 5 μm and smaller than 20 μm, and wherein the charging device is a device for contacting a charging member with the surface of the photosensitive member and applying a voltage to the charging member to charge the photosensitive member.

BRIEF DESCRIPTION OF THE DRAWINGS

FIG. 3A shows a state of DC bias ON, and FIG. 3C shows a state of DC bias OFF;

DESCRIPTION OF THE PREFERRED EMBODIMENTS

As the results of extensive investigations on the adaptability and applicability of a-Si(H, X) as the photoconductive member used in the electrophotographic image forming member, the present inventors have found that the aforementioned problems such as the film peeling can be solved by setting the thickness of the photoconductive layer in a range not smaller than 5 μm but smaller than 20 μm and by employing a charging device for contacting a cylindrical charging member with the surface of the photosensitive member and applying a voltage to the charging member to charge the photosensitive member, and they have thus reached the present invention.

In the photosensitive member of the present invention, the thickness of the conductive substrate is in a range of not smaller than 0.1 mm but smaller than 2.5 mm, and the thickness of the photoconductive layer is in a range of not smaller than 5 μm but smaller than 20 μm. The thinner photoconductive layer allows to sufficiently reduce the stress in the a-Si(H, X) film, thereby decreasing the peeling thereof to a practically acceptable level or completely no film peeling level.

However, as described in Japanese Patent Application Laid-open No. 08-015882, it has been considered difficult to make a photoconductive layer thinner, because a thickness thereof smaller than 20 μm results in practically unacceptable electrophotographic characteristics such as chargeability or sensitivity. Therefore, the present invention employs a charging device for contacting a charging member with the surface of the photosensitive member and applying a voltage to the charging member to charge the photosensitive member, whereby obtained is a potential substantially comparable to that in the conventional photosensitive member having the photoconductive layer with a thickness of 20 μm or more and there can be attained practically sufficient electrophotographic characteristics.

The charging device of the contact type is a device for bringing a charging member, to which a voltage is applied, into contact with a member to be charged, thereby charging the member to be charged to a predetermined potential, as disclosed in Japanese Patent Application Laid-open No. 09-120193. In comparison with the widely employed corona charging device, the charging device of the contact type has an advantage of making lower an applied voltage required for obtaining a predetermined potential on the surface to be charged. As the results of the intensive investigation, the present invention has been reached by a finding that since the contact charging is a charging using a constant potential, it is extremely advantageous for a photosensitive member with a low chargeability.

Figure 3A:
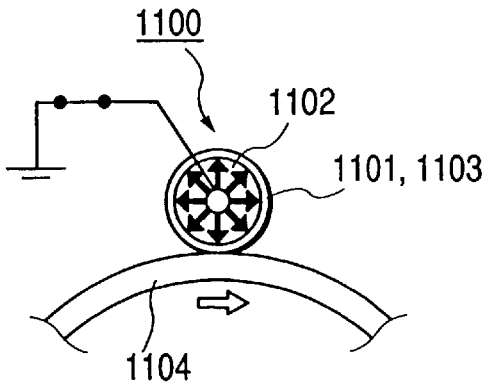
FIGS. 3A, 3B and 3C are schematic cross-sectional views showing an example of a contact charging method.
Figure 3B:
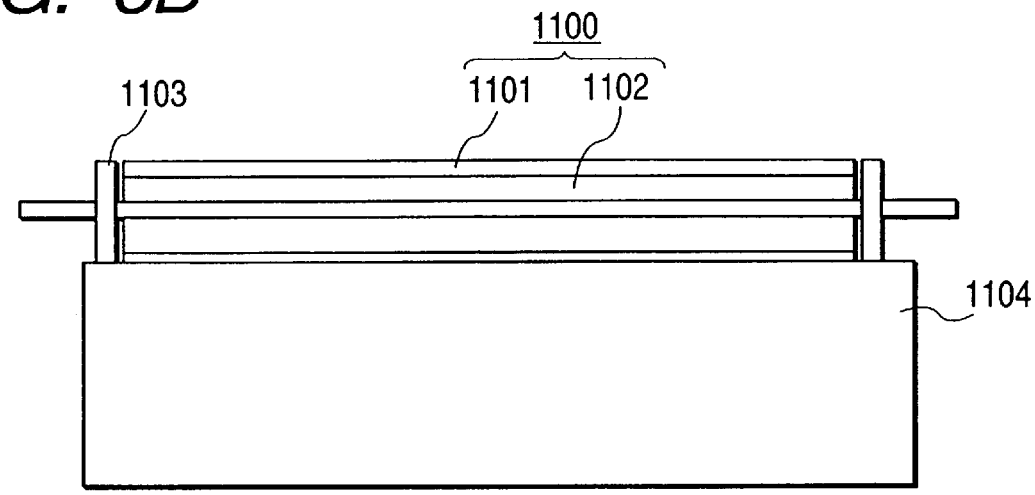
Figure 3C:
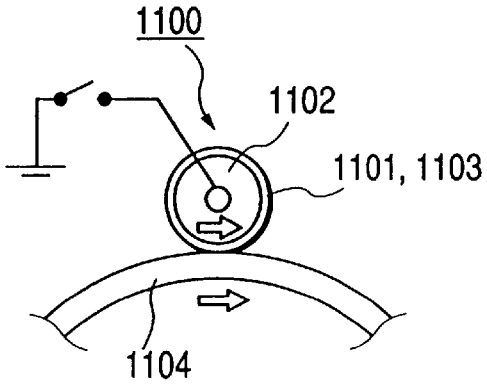

FIGS. 3A and 3B are respectively a schematic top view and a schematic side view of a charging member and a member to be charged in an embodiment of the contact charging device. FIGS. 3A and 3B also show a contact charging member 1100, a magnetic brush layer 1101 consisting of charge carrier in the contact charging member, a multi-pole magnetic member 1102 of the contact charging member, a spacer 1103 for defining a gap between the contact charging member and the photosensitive member, and a member to be charged (image bearing member) 1104 such as the photosensitive member. FIG. 3A shows a state in which the DC bias is applied to the contact charging member 1100, i.e., a DC bias ON state. Arrows in the multi-pole magnetic member 1102 in FIG. 3A indicate an example of the magnetic force. FIG. 3C shows a state in which the DC bias is not applied to the contact charging member 1100, i.e., a DC bias OFF state.

The multi-pole magnetic member 1102 of the contact charging member is composed of a magnetic member capable of having a multi-pole structure, for example a metallic or plastic magnet such as a ferrite magnet. Its magnetic flux density is variable depending on various factors such as the process speed, the electric field caused by the potential difference between the applied voltage and the non-charged portion, the dielectric constant of the member to be charged and the surface characteristics, but is preferably at least 500 Gauss, more preferably at least 1000 Gauss, measured at the position of the magnetic pole apart by 1 mm from the surface of the multi-pole magnetic member 1102.

The shortest distance between the photosensitive member and the multi-pole magnetic member 1102 has to be stably maintained at a constant value by suitable means such as a roller or a spacer 1103, in order to stably control the contact width (hereinafter referred to as "nip width") of the magnetic brush layer 1101. This distance is preferably within a range of 50 to 2000 μm, more preferably 100 to 1000 μm.

Also there may be provided a mechanism such as a blade for adjusting the nip.

The magnetic brush layer 1101 of the contact charging member 1100 can be generally composed of magnetic powder such as of ferrite or magnetite, or the carrier of a known magnetic toner. The particle size of the magnetic powder is generally within a range of 1 to 100 μm, preferably not larger than 50 μm. For improving the fluidity, the charge carriers of different particle sizes within the above-mentioned range may be used as a mixture.

In the above-described contact charging device, against the magnetic attractive force between the magnetic member and the charge carrier, the charge carriers may transfer to the photosensitive member, for example by a mechanical force such as frictional force caused by the rotation of the photosensitive member or an electrical attractive force resulting from an electric field caused by the potential difference between the magnetic brush layer and the non-charged portion of the surface of the photosensitive member, and a part of the charge carriers may be magnetically attracted to the sleeve (developing sleeve) of the developing unit. Thus, with an increase in the number of prints, the amount of the charge carrier attracted to the developing sleeve increases to hinder the image development with the developer on the surface of the photosensitive member, thereby causing longitudinal streaks in the continuous printing operation.

This problem can be prevented, as disclosed in Japanese Patent Application Laid-open No. 09-120193, by setting the distance between the circumferentially adjacent magnetic poles on the surface of the multi-pole magnetic member 1102 smaller than the circumferential width of the nip, whereby at least one magnetic pole can be present within the nip to increase within the nip the force which attracts the magnetic powder toward the multi-pole magnetic member side, thereby preventing the transfer of the magnetic powder toward the member to be charged by the electric field induced between the charging member and the member to be charged.

On the other hand, in the electrophotographic apparatus employing corona charging, it is known that products resulting from ozone are deposited on the surface of the photosensitive member to result in a faint image particularly under a high humidity condition. In the case of a photosensitive member with the relatively easily abraded surface such as an organic photoconductor (OPC), the ozone products formed on the surface can be easily removed for example with polishing means or the like, but an excessive polishing lowers the function of the photosensitive member and reduces the use life thereof. Also the surface insulating layer such as of the amorphous silicon photosensitive member or the CdS photosensitive member employed in the NP process is very hard so that the ozone oxides formed on the surface are difficult to remove by polishing.

It is therefore executed to heat the surface of the photosensitive member to about 35° C. to about 45° C. by a heater positioned in the interior or vicinity of the photosensitive member. This heating of the photosensitive member is executed for various purposes, but it is executed principally for preventing and eliminating the faint image appearing under a high humidity condition. The heating is intended to eliminate the moisture because the surface of the photosensitive member is chemically modified by ozone generated in the corona charger to form hydrophilic radicals (—OH, etc.) to cause moisture absorption, thereby inducing electrophotographically fatal phenomena such as lateral shift of the surface potential. Because $NO_x$, etc. generated by ozone are deposited on the surface of the photosensitive member and absorb moisture, the heating is also executed for the main purpose of removing the moisture.

The heating is principally achieved by an electric heater provided inside the photosensitive member, though hot air blowing thereto can also be used. There is conventionally adopted a method of temperature control by a rod-shaped heater arranged in the rotary shaft supporting the photosensitive member, but there is frequently employed, particularly in the a-Si photosensitive member, a method of arranging a plane-shaped heater on the internal periphery of the photosensitive member, in order to improve the precision of temperature control of the surface of the photosensitive member and to avoid unevenness in the temperature on the entire surface of the photosensitive member.

In the following the conventional heating means will be explained in detail.

Figure 4A:
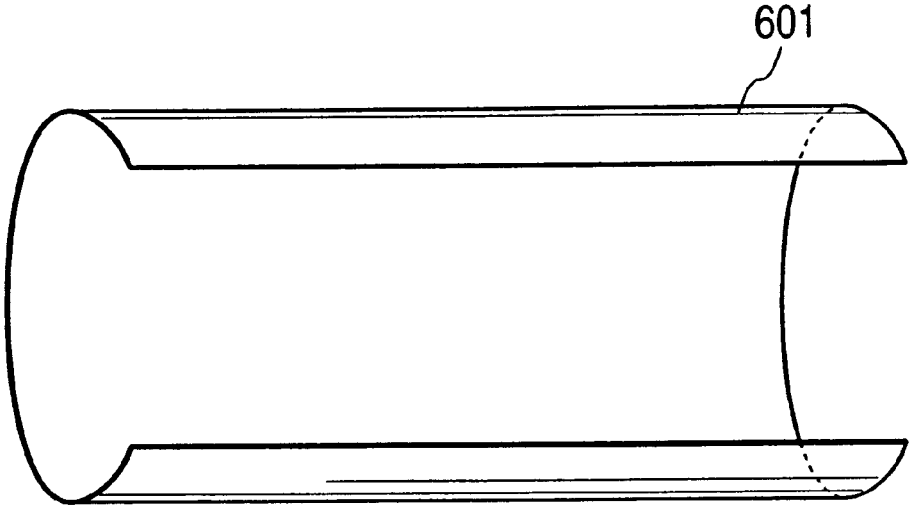
FIG. 4A is a schematic perspective view showing a heater and FIG. 4B is a schematic perspective view showing the heater applied to a photosensitive member.
Figure 4B:
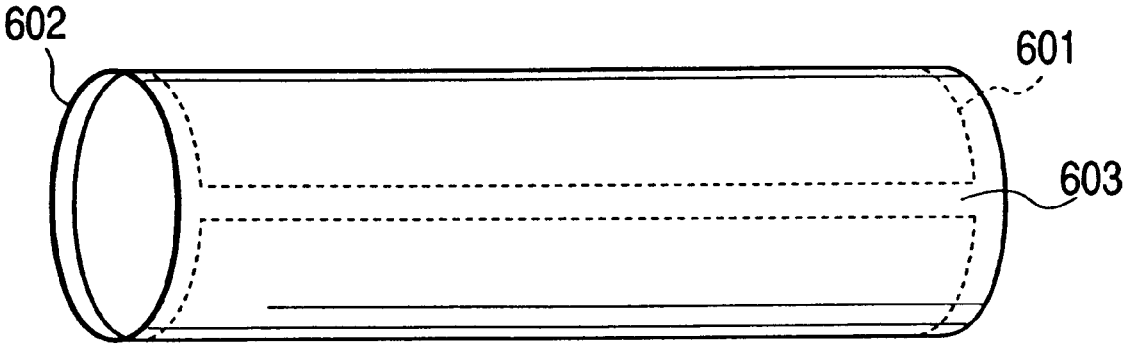

FIG. 4A is a schematic perspective view showing a plane-shaped heater 601 in a bent state prior to mounting on the photosensitive member, and FIG. 4B is a schematic perspective view showing a state in which the plane-shaped heater 601 is mounted, with a gap 603, on the interior of the photosensitive drum 602. As the heater for the photosensitive member, there are generally a rod-type heater (not shown in the drawings) not contacting the internal periphery of the photosensitive member and a plane-shaped heater contacting the internal periphery of the photosensitive member, but the latter shows a higher precision of temperature control.

Figure 5:
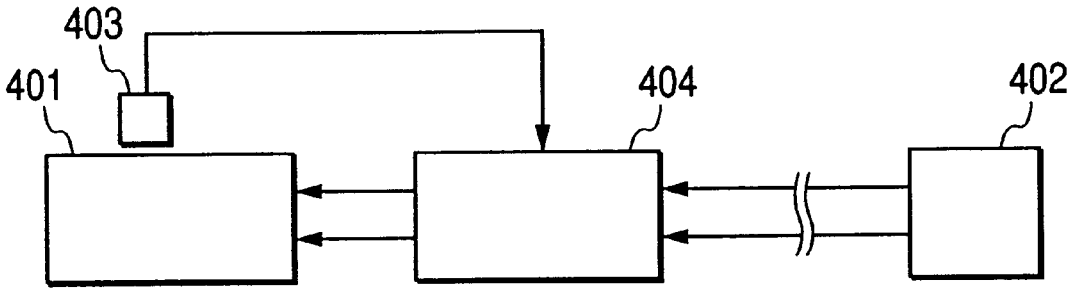
FIGS. 5 and 6 are schematic block diagrams showing examples of the temperature adjusting mechanism for the heater.
Figure 6:
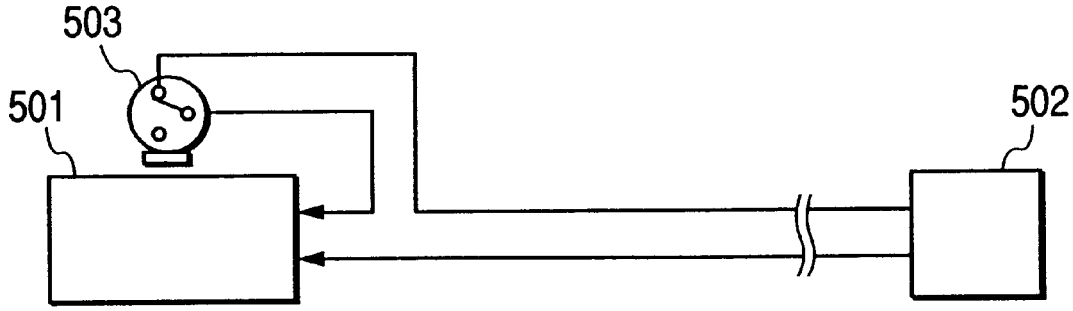

FIGS. 5 and 6 are block diagrams of the generally employed temperature control.

FIG. 5 shows a heater 401 for the photosensitive member, an AC power source 402, a temperature feedback thermistor 403, and a control circuit 404 for on-off switching or switching in several stages of the power supply to the heater corresponding to the resistance of the thermistor 403. Waved lines in FIG. 5 indicate the boundary between the main body of the electrophotographic apparatus and the photosensitive member unit, both being in mutual contact for example by slip rings. Since the thermistor 403 shows a lower resistance at a higher temperature, the temperature of the thermistor is fed back to the control circuit, thereby achieving temperature control.

FIG. 6 shows a heater 501 for the photosensitive member, an AC power source 502, and a temperature controlling thermoswitch 503. Waved lines in FIG. 6 indicate the boundary between the main body of the electrophotographic apparatus and the photosensitive member unit, both being in mutual contact for example by slip rings. Since the thermoswitch 503 is connected so as to be turned off at a high temperature, thereby achieving temperature control. The turn-off temperature of the thermoswitch is specific thereto.

In configuration, the thermistor control shown in FIG. 5 has a higher precision of temperature control. Particularly, the a-Si photosensitive member shows a temperature dependence of the potential as large as 1 to 6 V/°C. in the dark potential (300 to 500 V) and 1 to 3 V/° C. in the light potential (50 to 200 V), there is often required a precision of ±1° C. in the temperature control and the configuration shown in FIG. 5 is preferred for this case.

The above precision of the temperature control is achieved in the photosensitive member alone or in a static state where the photosensitive member is still in the electrophotographic apparatus. However, the temperature of the photosensitive member is significantly affected by the room temperature and the copying mode in a dynamic state, i.e., in the actual use state of the photosensitive member involving the paper passing in the electrophotographic apparatus. More specifically, the amount of heat carried away by the paper from the photosensitive member is dependent on the paper temperature, which is affected by the room temperature and by the copying mode (namely whether the copying paper is newly fed from the exterior of the electrophotographic apparatus or fed after passing the fixing unit as in the case of double-side copying or multiple copying). The amount of heat carried away by the paper from the photosensitive member is also dependent on the frequency of contact between the paper and the photosensitive member, so that the influence of copying mode (single- or double-side copying, number of copying sheets, paper size (dimension/thickness), etc.). Consequently, in order to maintain the photosensitive member at a constant temperature in the dynamic state, it is necessary to supply the heater with an electric power far larger than that required for reaching the temperature equilibrium, thereby improving the response.

In the conventional system, however, an increased electric power supply leads to an uneven temperature distribution because of the following two reasons.

The first reason is based on the following problem in the shape of the heater. When a plane-shaped heater is bent and adhered to the internal periphery of the cylindrical photosensitive member, a portion of the photosensitive member corresponding to the seam of this heater shows inferior temperature response, thereby resulting in a temperature difference from the heater. For solving the problem, there may be employed a seamless heater.

The second reason is based on the following problem in the control system. The switching control system by a circuit employing a thermistor has various problems depending on the temperature detecting position and the employed control circuit and generally tends to increase the overshooting and the ripple in the temperature control when an electric power increases. There is required an expensive control circuit in order to eliminate these problems. For this reason, in consideration of the practical cost, certain unevenness in the temperature has to be accepted.

On the other hand, a PTC heater (positive resistance temperature coefficient heater or self-temperature-controlling heater) having a temperature dependence in the resistance itself of the heater and showing a higher resistance at a higher temperature is used to be able to maintain the resistor at a constant temperature. Therefore, it is unnecessary to use the temperature control circuit, and there is in principle free from the overshoot and ripple phenomena.

The PTC heater is self-controlled at an appropriate temperature by the PTC characteristics of the PTC resistor between the electrodes, and is known in a plane-shaped heater formed by integrating a heater layer and electrodes with a film-shaped insulating layer via heat adhesive resin by lamination or by adhesion under heat and pressure. There are known various configurations such as the PTC heater employing a pair of electrodes as disclosed in Japanese Patent Publication Nos. 57-43996 and 55-40161, and other configurations according to various needs such as for a high temperature or a high electric power, but the basic configuration is the same in all PTC heaters.

Consequently, in the electrophotographic apparatus which requires temperature control with a large electric power as explained in the foregoing, the use of the PTC heater with the seamless structure is extremely effective.

As explained in the foregoing, the use of a photoconductive layer with a thickness not smaller than 5 $\mu$m and smaller than 20 $\mu$m allows to sufficiently suppress the stress in the deposited a-Si(H, X) film to decrease the peeling of the deposited a-Si(H, X) film to a practically acceptable level or to completely no film peeling level, and the thickness of the drum-shaped metal substrate can be set to be not smaller than 0.1 mm and smaller than 2.5 mm, thereby significantly reducing the manufacturing cost thereof. Under the above conditions, a charging device capable of bringing a charging member into contact with the surface of the photosensitive member and applying a voltage to the charging member to charge the photosensitive member exhibits the substantially same potential as that in the conventionally employed photosensitive member with a film thickness of 20 $\mu$m or more. Therefore, it is possible to obtain practically sufficient electrophotographic characteristics, and the disadvantages caused by reducing the thickness of the photoconductive layer can be reduced to a practically acceptable level or completely eliminated.

Also in the case of using a heater in the drum-shaped metal substrate with a thickness not smaller than 0.1 mm and smaller than 2.5 mm, since the temperature slope between the heater and the surface of the photosensitive member becomes reduced, use of a seamless PTC heater makes it possible to supply an electric power far larger than that required for reaching the temperature equilibrium, thereby improving the response, also enabling high-speed temperature increase and attaining temperature control without overshoot and ripple phenomena even in the dynamic state involving the paper passing.

The external diameter of the drum-shaped metal substrate is preferably set within a range of 20 mm to 60 mm in consideration of the mechanical strength thereof.

Figure 12:
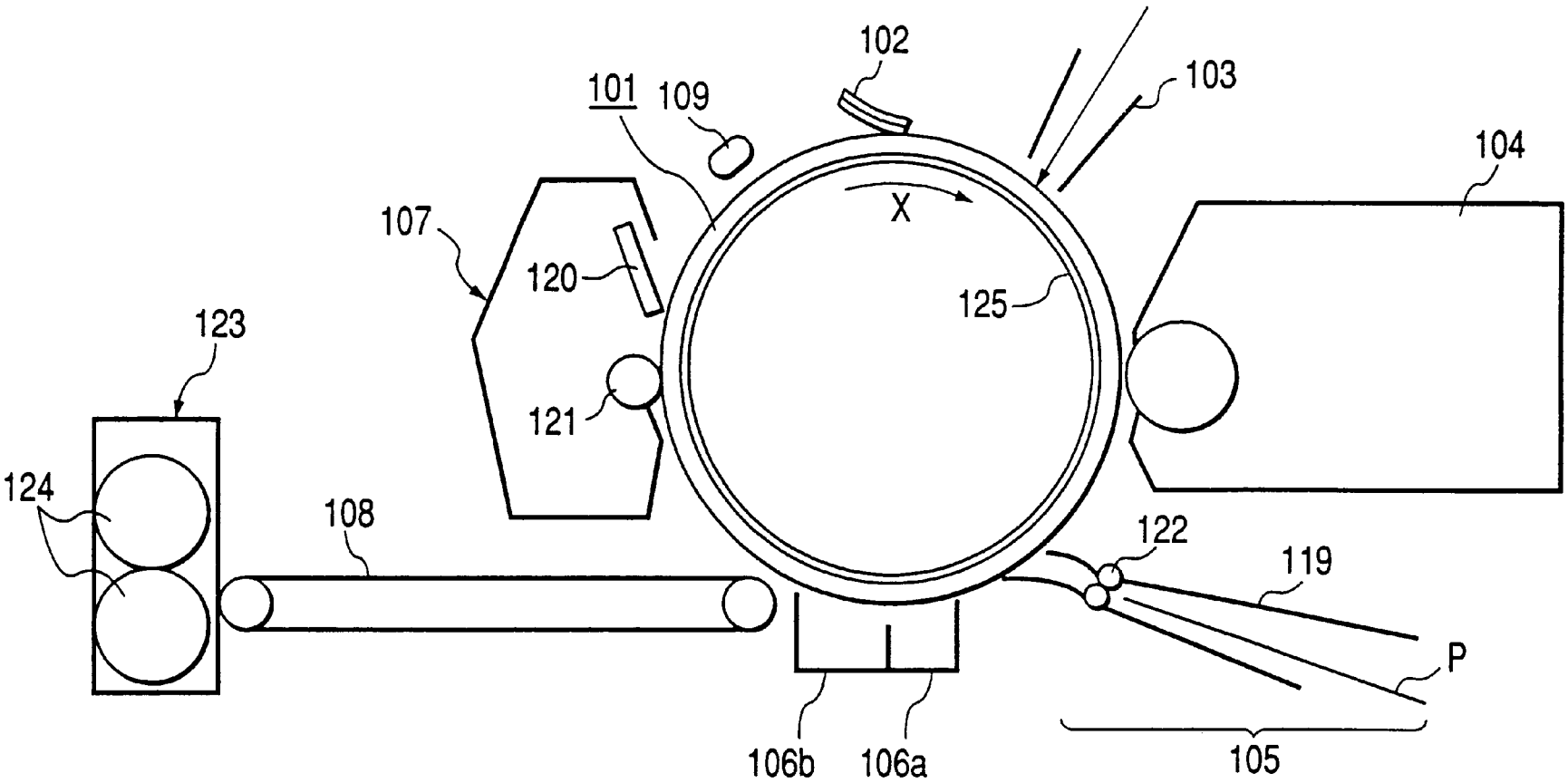
FIG. 12 is a schematic view showing an example of the image forming apparatus.

FIG. 12 is a schematic view showing an example of the image forming apparatus.

Around an electrophotographic photosensitive member (hereinafter simply referred to as "photosensitive member") 101 rotated in a direction of an arrow X, there are successively arranged clockwise a contact charger 102, an electrostatic latent image forming position 103, a developing unit 104, a transfer paper supply system 105, a transfer charger 106*a*, a separation charger 106*b*, a cleaner 107, a conveying system 108 and a charge eliminating light source 109. The photosensitive member 101 may be temperature controlled by a plane-shaped internal heater 125.

The surface of the photosensitive member 101 is uniformly charged by the contact charger 102 and is subjected to imagewise exposure in the electrostatic latent image forming position 103 to form an electrostatic latent image thereon.

The electrostatic latent image is rendered visible as a toner image by a developing sleeve which is coated with developer (toner) of the developing unit 104.

On the other hand, the toner image formed on the photosensitive member 101 is transferred by the transfer charger 106*a* to a transfer material (paper) P which is supplied by the transfer paper supply system 105 with guiding by a transfer paper guide 119 thereof and top end adjustment by registration rollers 122. The transfer material P is then separated from the photosensitive member 101 by the separation charger 106*b* and/or separation means such as a separation nail (not shown in the drawings), then transported by the conveying system 108, subjected to the fixation of the toner image on the surface by fixing rollers 124 in the fixing unit 123 and discharged from the image forming apparatus.

The remaining toner, paper dusts, etc. on the surface of the photosensitive member 101 after the toner image transfer are eliminated by a cleaning blade 120 and a cleaning roller (or brush) 121 in the cleaning unit 107, and the cleaned surface is used for the next image formation.

The present invention will be clarified further by the following examples, but the present invention is not limited by the examples.

EXAMPLE 1

Figure 1A:
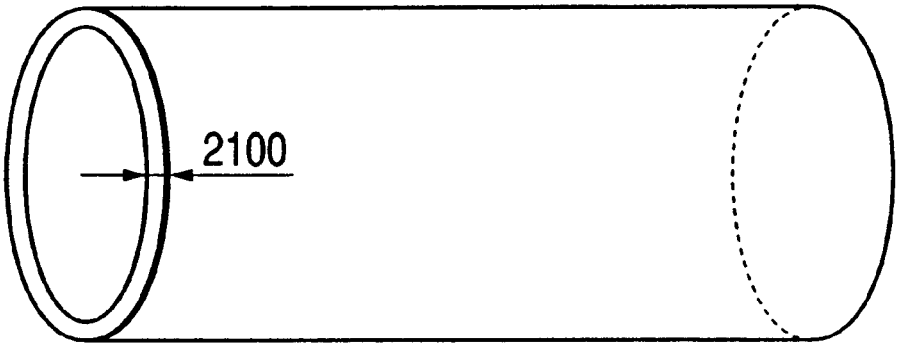
FIGS. 1A and 1B are respectively a schematic perspective view and a schematic cross-sectional view showing a photosensitive member.
Figure 1B:
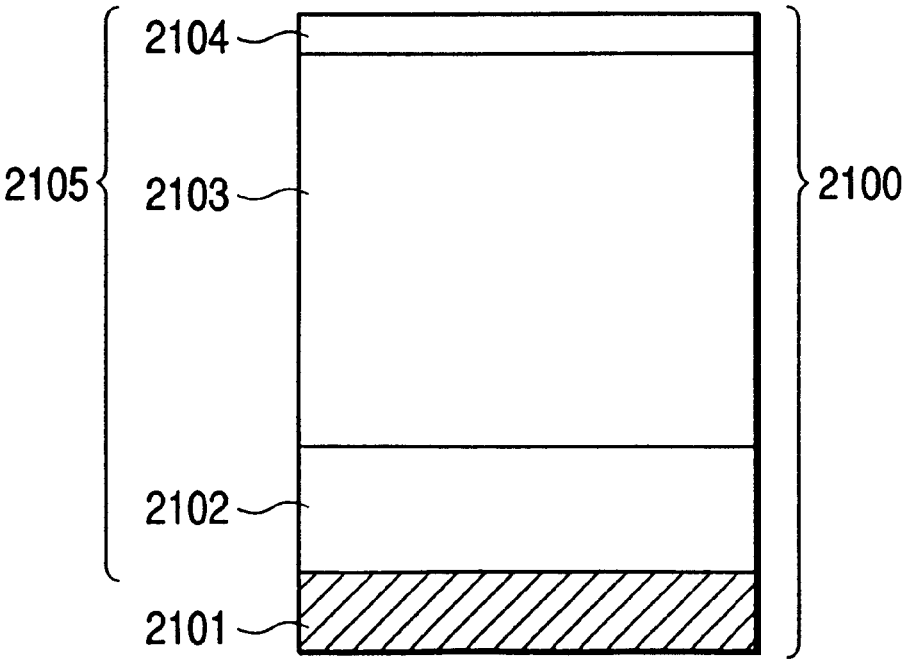
Figure 2:
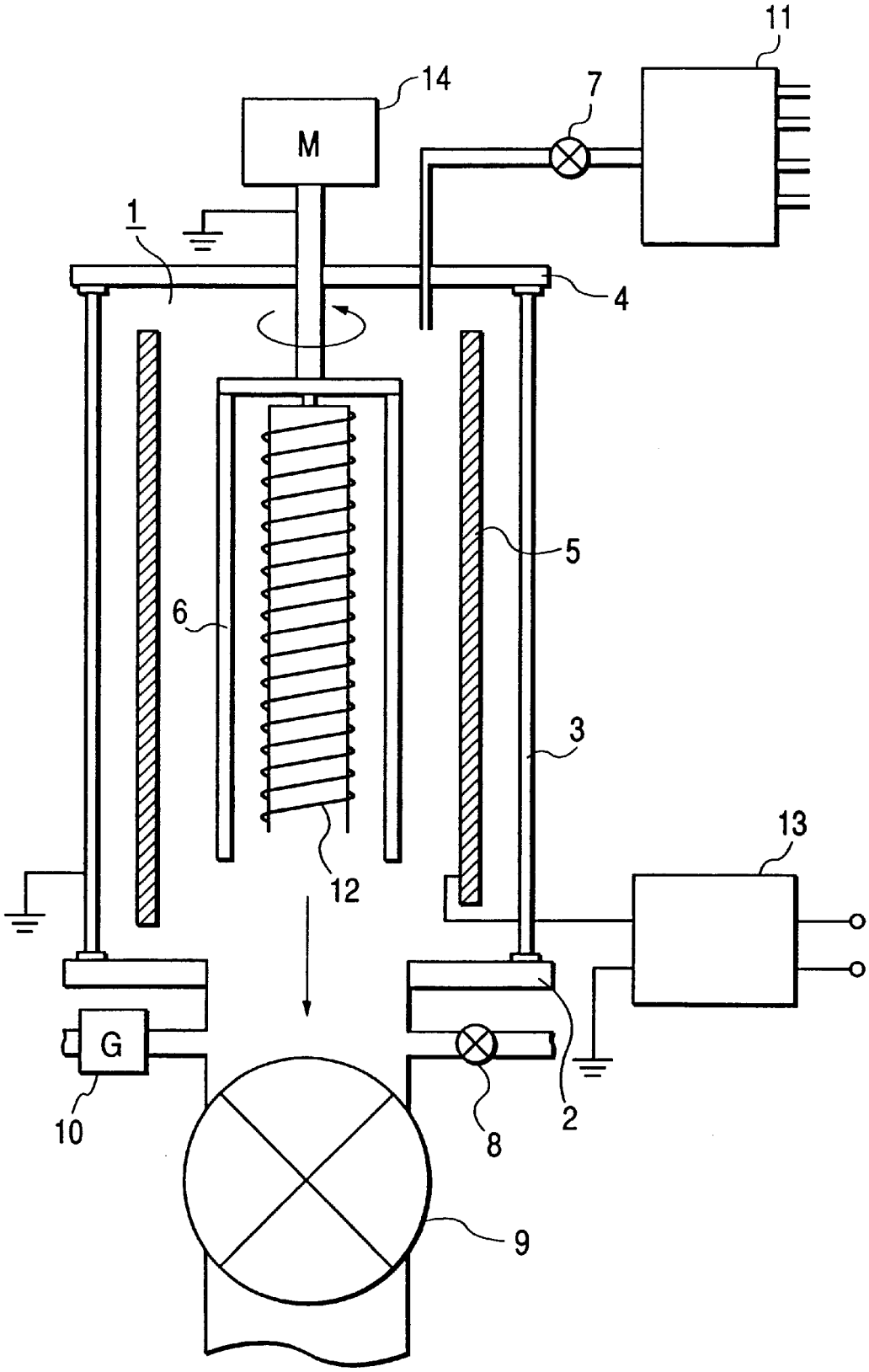
FIG. 2 is a schematic view showing an example of the deposition apparatus.

Photosensitive drums were produced with the apparatus for producing the electrophotographic photoconductive member, shown in FIG. 2, and with the aforementioned glow discharge decomposition method, by depositing, on aluminum conductive substrates of different thicknesses within a range of 0.5 mm to 5.0 mm, a deposited a-Si:H film under the following conditions so as to obtain a photoconductive layer with a thickness of 3, 5, 15, 20, 35 or 50 μm.

| | |
|---|---|
| Drum-shaped substrate temperature: | 250° C. |
| Internal pressure of deposition chamber during formation of deposited film: | 0.03 Torr |
| Discharge frequency: | 13.56 MHZ |
| Deposited film-forming rate: | 20 Å/sec |
| Discharge power: | 0.18 W/cm$^2$ |

Thus produced electrophotographic photosensitive drums were observed for the state of the film peeling, and was then installed in a copying machine modified for experimental purpose for imaging test to obtain images. The obtained images were evaluated for the influence of film peeling and fogging. The charger was of a contact type as shown in FIGS. 3A and 3B. The obtained results are shown in Tables 1 and 2.

TABLE 1

Evaluation of film peeling

| | | Thickness of photoconductive layer (μm) | | | | | |
|---|---|---|---|---|---|---|---|
| | | 3 | 5 | 15 | 20 | 35 | 50 |
| Thickness of conductive substrate (mm) | 0.05 | X | X | — | — | — | — |
| | 0.10 | Δ | Δ | Δ | X | X | X |
| | 0.50 | ○ | ○ | Δ | X | X | X |
| | 1.00 | ◎ | ○ | ○ | X | X | X |
| | 1.50 | ◎ | ◎ | ○ | Δ | X | X |
| | 2.00 | ◎ | ◎ | ○ | Δ | X | X |
| | 2.50 | ◎ | ◎ | ◎ | ○ | Δ | Δ |
| | 3.00 | ◎ | ◎ | ◎ | ◎ | ○ | ○ |
| | 3.50 | ◎ | ◎ | ◎ | ◎ | ◎ | ○ |
| | 5.00 | ◎ | ◎ | ◎ | ◎ | ◎ | ◎ |

◎: very good
○: good
Δ: no generation of practical problem
X : generation of practical problem in some cases
—: not measured

TABLE 2

Evaluation of fogging (contact charging system)

| | | Thickness of photoconductive layer (μm) | | | | | |
|---|---|---|---|---|---|---|---|
| | | 3 | 5 | 15 | 20 | 35 | 50 |
| Thickness of conductive substrate (mm) | 0.05 | X | X | — | — | — | — |
| | 0.10 | X | Δ | ○ | ○ | ◎ | ◎ |
| | 0.50 | X | Δ | ○ | ○ | ◎ | ◎ |
| | 1.00 | X | Δ | ○ | ○ | ◎ | ◎ |
| | 1.50 | X | Δ | ○ | ○ | ◎ | ◎ |
| | 2.00 | X | Δ | ○ | ○ | ◎ | ◎ |
| | 2.50 | X | Δ | ○ | ○ | ◎ | ◎ |
| | 3.00 | X | Δ | ○ | ○ | ◎ | ◎ |
| | 3.50 | X | Δ | ○ | ○ | ◎ | ◎ |
| | 5.00 | X | Δ | ○ | ○ | ◎ | ◎ |

◎: very good
○: good
Δ: no generation of practical problem
X : generation of practical problem in some cases
—: not measured With respect to the evaluation of film peeling, as clearly seen from Table 1, when the thickness of the conductive substrate was increased from 0.1 mm to 2.5 mm, satisfactory image without any practical influence of the film peeling could be obtained by making the thickness of the photoconductive layer smaller than 20 μm. However, when the thickness of the conductive substrate was reduced to 0.05 mm, the film peeling occurred at the film deposition or at the measurement, whereby the measurement was possible only up to 5 μm in the thickness of the photoconductive layer.

With respect to the evaluation of fogging, as clearly seen from Table 2, it was scarcely dependent on the thickness of the conductive substrate but was dependent on the thickness of the photoconductive layer. The photosensitive member with a film thickness of 3 μm showed severely fogging and was incapable of providing a satisfactory image, because a sufficient contrast in potential could not be secured.

With respect to the evaluation of circularity, in the photosensitive drum comprising the conductive substrate of 1.5 mm or 2.0 mm in thickness and the photoconductive layer of 20 μm or more in thickness, the difference between the most protruding portion and the most recessed portion was close to 100 μm, while the difference was not more than 30 μm in the photosensitive drum comprising the conductive substrate of 1.5 mm or 2.0 mm in thickness and the photoconductive layer of 5 μm or 15 μm in thickness. Also in the photosensitive drum comprising the conductive substrate of 2.5 mm or 3.0 mm in thickness and the photoconductive layer of 20 μm or more in thickness, the difference was about 30 μm, while the difference was about 10 μm to about 20 μm in the photosensitive drum comprising the conductive substrate of 2.5 mm or 3.0 mm in thickness and the photoconductive layer of 5 μm or 15 μm in thickness. Also in the photosensitive drum comprising the conductive substrate of 3.5 mm or 5.0 mm in thickness, the difference was not more than a range of 10 μm to 20 μm or less in any thickness of the photoconductive layer. The details of this evaluation are shown in Table 3.

TABLE 3

Evaluation of circularity

| | | Thickness of photoconductive layer (μm) | | | | | |
|---|---|---|---|---|---|---|---|
| | | 3 | 5 | 15 | 20 | 35 | 50 |
| Thickness of conductive substrate (mm) | 0.05 | X | X | — | — | — | — |
| | 0.10 | Δ | Δ | Δ | X | X | X |
| | 0.50 | ○ | ○ | Δ | X | X | X |
| | 1.00 | ◎ | ○ | ○ | Δ | X | X |
| | 1.50 | ◎ | ○ | ○ | Δ | Δ | X |
| | 2.00 | ◎ | ◎ | ◎ | ○ | Δ | X |
| | 2.50 | ◎ | ◎ | ◎ | ○ | ○ | Δ |
| | 3.00 | ◎ | ◎ | ◎ | ◎ | ○ | ○ |
| | 3.50 | ◎ | ◎ | ◎ | ◎ | ◎ | ◎ |
| | 5.00 | ◎ | ◎ | ◎ | ◎ | ◎ | ◎ |

◎: very good
○: good
Δ: no generation of practical problem
X : generation of practical problem in some cases
—: not measured

Comparative Example 1

Photosensitive drums were produced under the same conditions as in Example 1, and the obtained images were evaluated for the fogging under the same conditions as in Example 1, except that the charger was replaced by a corona charger. The obtained results are shown in Table 4. Similarly to Example 1, the results were scarcely dependent on the thickness of the conductive substrate but was dependent on the thickness of the photoconductive layer. As clearly seen from Table 4, the drum comprising the photoconductive layer of 3, 5 or 15 μm in thickness showed severely fogging and could not provide satisfactory images because a sufficient contrast in potential could not be secured.

TABLE 4

Evaluation of fogging (corona charging system)

| | | Thickness of photoconductive layer (μm) | | | | | |
|---|---|---|---|---|---|---|---|
| | | 3 | 5 | 15 | 20 | 35 | 50 |
| Thickness of conductive substrate (mm) | 0.05 | X | X | — | — | — | — |
| | 0.10 | X | X | X | Δ | ○ | ◎ |
| | 0.50 | X | X | X | Δ | ○ | ◎ |
| | 1.00 | X | X | X | Δ | ○ | ◎ |
| | 1.50 | X | X | X | Δ | ○ | ◎ |
| | 2.00 | X | X | X | Δ | ○ | ◎ |
| | 2.50 | X | X | X | Δ | ○ | ◎ |
| | 3.00 | X | X | X | Δ | ○ | ◎ |
| | 3.50 | X | X | X | Δ | ○ | ◎ |
| | 5.00 | X | X | X | Δ | ○ | ◎ |

◎: very good
○: good
Δ: no generation of practical problem
X : generation of practical problem in some cases
—: not measured

EXAMPLE 2

Figure 7A:
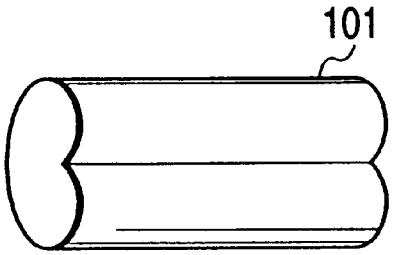
FIGS. 7A and 7B are schematic perspective views showing examples of a PCT heater.
Figure 7B:
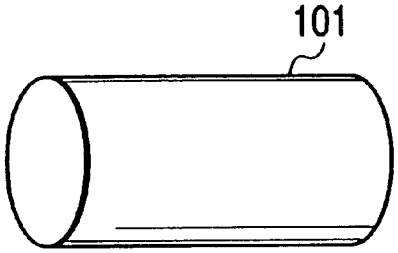
Figure 8:
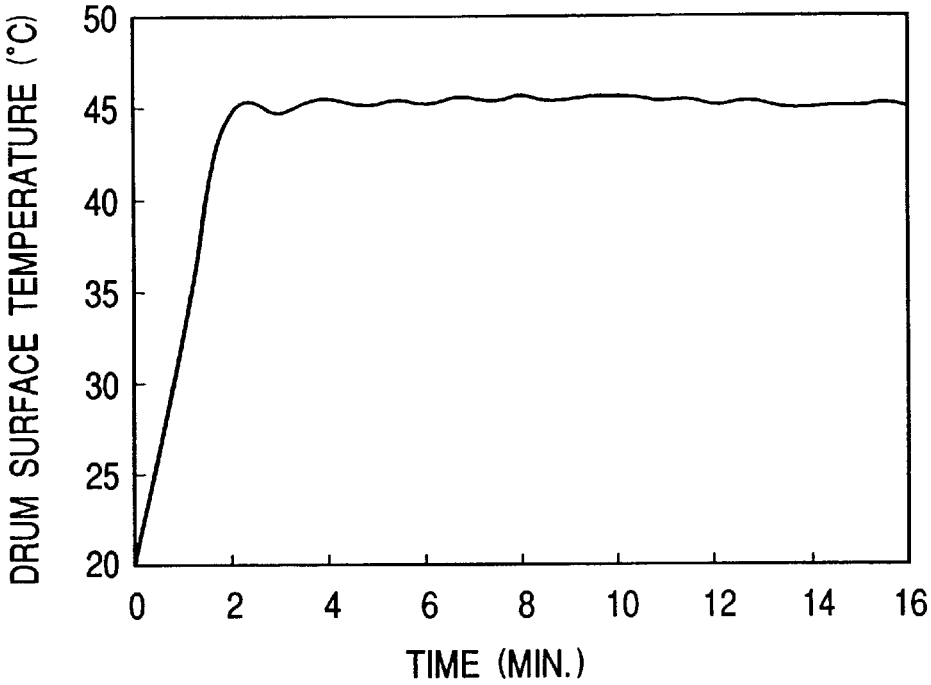
FIGS. 8 and 9 are graphs showing examples of the surface temperature of the photosensitive member in a still state thereof (static state)

Photosensitive members (drums) comprising the conductive substrate with a different thickness and the photoconductive layer with a different thickness were produced by using a PTC heater of flexible seamless cylindrical shape as shown in FIG. 7B, adhered to the internal periphery of the photosensitive member, and by using no temperature control circuit. The photosensitive member was set on an experimental equipment, and an optimum power corresponding to the heat capacity of the photosensitive member was supplied to the heater. The temperature variation of the surface of the photosensitive member (drum) was measured with the lapse of time from the starting of supplying the power in a static state in which the temperature of the photosensitive member was controlled so as to reach 45° C. The obtained results are shown in FIG. 8 and Table 5.

TABLE 5

Evaluation of variation of drum surface temperature in static state (PTC heater)

| | | Thickness of photoconductive layer (μm) | | | | | |
|---|---|---|---|---|---|---|---|
| | | 3 | 5 | 15 | 20 | 35 | 50 |
| Thickness of conductive substrate (mm) | 0.05 | ◎ | ◎ | — | — | — | — |
| | 0.10 | ◎ | ◎ | ◎ | ◎ | ◎ | ◎ |
| | 0.50 | ◎ | ◎ | ◎ | ◎ | ◎ | ◎ |
| | 1.00 | ◎ | ◎ | ◎ | ◎ | ◎ | ◎ |
| | 1.50 | ◎ | ◎ | ◎ | ◎ | ◎ | ◎ |
| | 2.00 | ◎ | ◎ | ◎ | ◎ | ◎ | ◎ |
| | 2.50 | ◎ | ◎ | ◎ | ◎ | ◎ | ◎ |
| | 3.00 | ○ | ○ | ○ | ○ | ○ | ○ |
| | 3.50 | ○ | ○ | ○ | ○ | ○ | ○ |
| | 5.00 | ○ | ○ | ○ | ○ | ○ | ○ |

◎: very good
○: good
—: not measured

The photosensitive members comprising the conductive substrate of 0.05 mm in thickness showed film peeling at the film deposition or at the measurement because of the insufficient strength of the conductive substrate, so that the measurement was possible only up to a film thickness of 5 μm.

FIGS. 7A and 7B respectively show the shapes of the heater for the photosensitive member prior to and after mounting on the photosensitive member. Mounting or detachment of the heater is executed by partially deforming the heater as shown in FIG. 7A, thereby reducing the external diameter. Upon mounting in the photosensitive member, the heater returns to the cylindrical shape, thereby adhering to the internal periphery of the photosensitive member and has an external diameter equal to the internal diameter of the photosensitive member.

FIG. 8 shows a representative example of the actual measurements, and the a substantially same tendency was obtained in all the measuring points on the photosensitive member. Even in the case of high-speed heating with a large electric power, there was not observed the temperature difference depending on the measuring position at the switching operation and the temperature variation with the lapse of time in the same measuring position (ripple in temperature control).

Also as shown in Table 5, there was scarcely observed dependence on the thickness of the photoconductive layer, and satisfactory results were obtained in all the cases when the optimum electric power corresponding to the heat capacity of the photosensitive member was employed. More satisfactory results were obtained in the case of the thickness of the conductive substrate smaller than 2.5 mm.

Comparative Example 2

Figure 9:
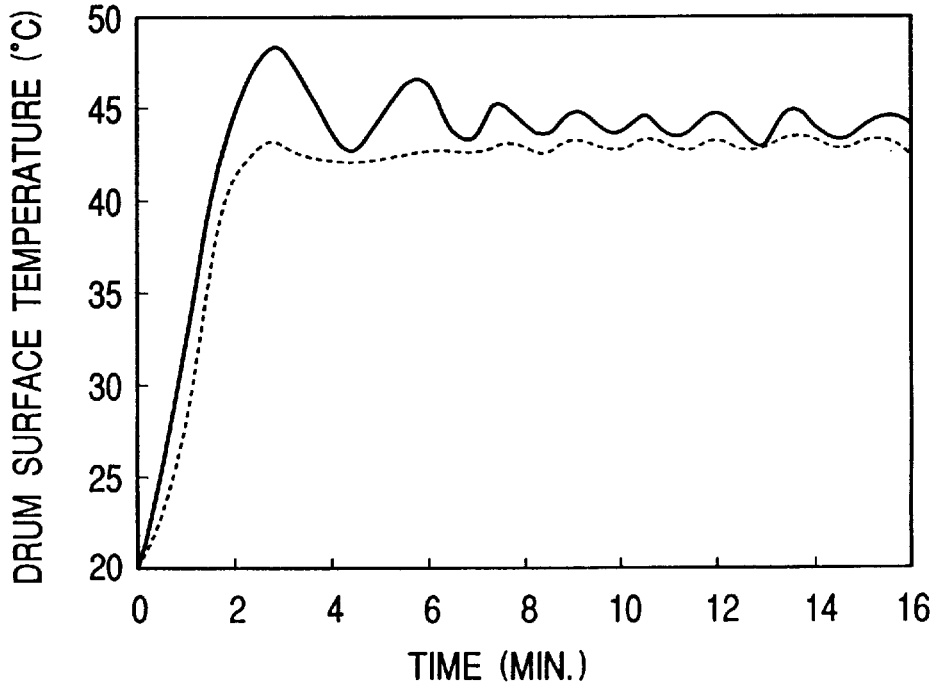

Photosensitive members comprising the conductive substrate with a different thickness and the photoconductive layer with a different thickness were produced by using a temperature control circuit as shown in FIG. 5 and a conventional seamed heater of plane shape rounded and adhered to the internal periphery of the photosensitive member as shown in FIGS. 4A and 4B or a conventional seamless, cylindrical, flexible heater adhered to the internal periphery of the photosensitive member. The photosensitive member was set on an experimental equipment, and the power used in Example 2 corresponding to the heat capacity of the photosensitive member was supplied to the heater. The temperature variation of the surface of the photosensitive member (drum) was measured with the lapse of time from the starting of supplying the power in a static state in which the temperature of the photosensitive member was controlled so as to reach 45° C. The obtained results are shown in FIG. 9 and Table 6.

TABLE 6

Evaluation of variation of drum surface temperature in static state (conventional heater + control circuit)

| | | Thickness of photoconductive layer (μm) | | | | | |
|---|---|---|---|---|---|---|---|
| | | 3 | 5 | 15 | 20 | 35 | 50 |
| Thickness of conductive substrate (mm) | 0.05 | ⊙ | ⊙ | — | — | — | — |
| | 0.10 | ⊙ | ⊙ | ⊙ | ⊙ | ⊙ | ⊙ |
| | 0.50 | ⊙ | ⊙ | ⊙ | ⊙ | ⊙ | ⊙ |
| | 1.00 | ⊙ | ⊙ | ⊙ | ⊙ | ⊙ | ⊙ |
| | 1.50 | ○ | ○ | ○ | ○ | ○ | ○ |
| | 2.00 | ○ | ○ | ○ | ○ | ○ | ○ |
| | 2.50 | ○ | ○ | ○ | ○ | ○ | ○ |
| | 3.00 | Δ | Δ | Δ | Δ | Δ | Δ |
| | 3.50 | Δ | Δ | Δ | Δ | Δ | Δ |
| | 5.00 | Δ | Δ | Δ | Δ | Δ | Δ |

⊙: very good
○: good
Δ: no generation of practical problem
—: not measured

The photosensitive members comprising the conductive substrate of 0.05 mm in thickness showed film peeling at the film deposition or at the measurement because of the insufficient strength of the conductive substrate, so that the measurement was possible only up to a film thickness of the photoconductive layer of 5 μm.

As shown in FIG. 9, the seamed heater showed a large temperature difference at the switching operation, between the seam portion indicated by a broken line in FIG. 9 and the seamless portion indicated by a solid line in FIG. 9. On the other hand, in the seamless heater, all the measuring points showed similar results as indicated by a solid line in FIG. 9, so that the temperature difference between the measuring positions was not observed at the switching operation but the temperature variation with the lapse of time in the same measuring position (ripple in temperature control) was observed.

Even the conventional heaters of these types, which were practically acceptable in the conventional use conditions, showed the above-mentioned tendency in the case of high-speed heating with a large electric power as shown in Table 6, particularly in the case of the large thickness of the conductive substrate.

EXAMPLE 3

Figure 10:
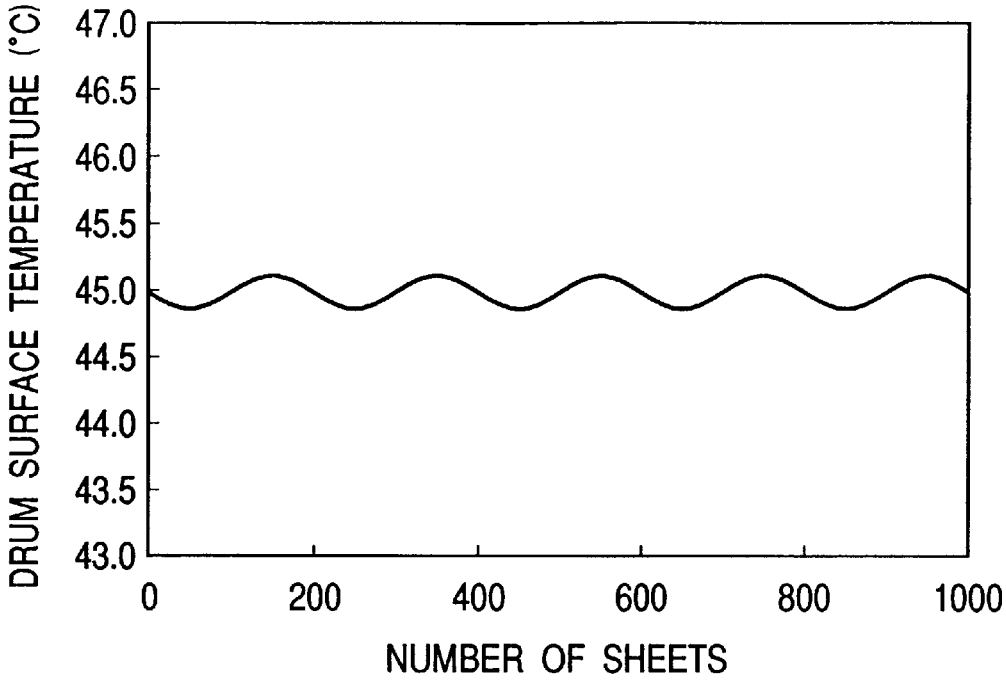
FIGS. 10 and 11 are graphs showing examples of the surface temperature of the photosensitive member in a paper passing state (dynamic state)

Photosensitive members comprising the conductive substrate with a different thickness and the photoconductive layer with a different thickness were produced by using a PTC heater of a flexible seamless cylindrical shape as shown in FIG. 7B and adhered to the internal periphery of the photosensitive member and by using no temperature control circuit. The photosensitive member was set on an experimental equipment, and an optimum power corresponding to the heat capacity of the photosensitive member was supplied to the heater and was controlled so that the temperature of the photosensitive member reached 45° C. The variation of the surface temperature of the photosensitive member (drum) was measured with the lapse of time while papers were passed continuously in an environmental temperature of 15° C. The obtained results are shown in FIG. 10 and Table 7.

TABLE 7

Evaluation of variation of drum surface temperature in dynamic state (PTC heater)

| | | Thickness of photoconductive layer (μm) | | | | | |
|---|---|---|---|---|---|---|---|
| | | 3 | 5 | 15 | 20 | 35 | 50 |
| Thickness of conductive substrate (mm) | 0.05 | Δ | Δ | — | — | — | — |
| | 0.10 | ○ | ○ | ○ | ○ | ○ | ○ |
| | 0.50 | ○ | ○ | ○ | ○ | ○ | ○ |
| | 1.00 | ○ | ○ | ○ | ○ | ○ | ○ |
| | 1.50 | ⊙ | ⊙ | ⊙ | ⊙ | ⊙ | ⊙ |
| | 2.00 | ⊙ | ⊙ | ⊙ | ⊙ | ⊙ | ⊙ |
| | 2.50 | ⊙ | ⊙ | ⊙ | ⊙ | ⊙ | ⊙ |
| | 3.00 | ⊙ | ⊙ | ⊙ | ⊙ | ⊙ | ⊙ |
| | 3.50 | ⊙ | ⊙ | ⊙ | ⊙ | ⊙ | ⊙ |
| | 5.00 | ⊙ | ⊙ | ⊙ | ⊙ | ⊙ | ⊙ |

⊙: very good
○: good
Δ: no generation of practical problem
—: not measured

The photosensitive members comprising the conductive substrate of 0.05 mm in thickness showed film peeling at the film deposition or at the measurement because of the insufficient strength of the conductive substrate, so that the measurement was possible only up to a film thickness of the conductive substrate of 5 μm.

FIG. 10 shows a representative example of the actual measurements. As shown in Table 7, there was scarcely observed the dependency of the thickness of the photoconductive layer on the temperature variation, and satisfactory results were obtained in all the cases when the optimum electric power corresponding to the heat capacity of the photosensitive member was employed. Particularly, more satisfactory results were obtained in the case of a larger thickness of the conductive substrate, because of the larger heat capacity.

The above constitution eliminated the temperature variation with the lapse of time (ripple in temperature control) even in the dynamic state, thereby eliminating the unevenness in the potential due to the aforementioned temperature characteristics to prevent the small unevenness of the image density conventionally generated in the continuous paper feeding.

Also in the so-called "potential control" utilizing potential measuring means and controlling the latent image forming condition by the charge amount or the light amount, the elimination of uneven potential eliminates the conventional potential control fluctuation due to the uneven potential resulting from the temperature characteristics, i.e., control potential variation, thereby improving the convergency of potential and the stability of the image density.

Comparative Example 3

Figure 11:
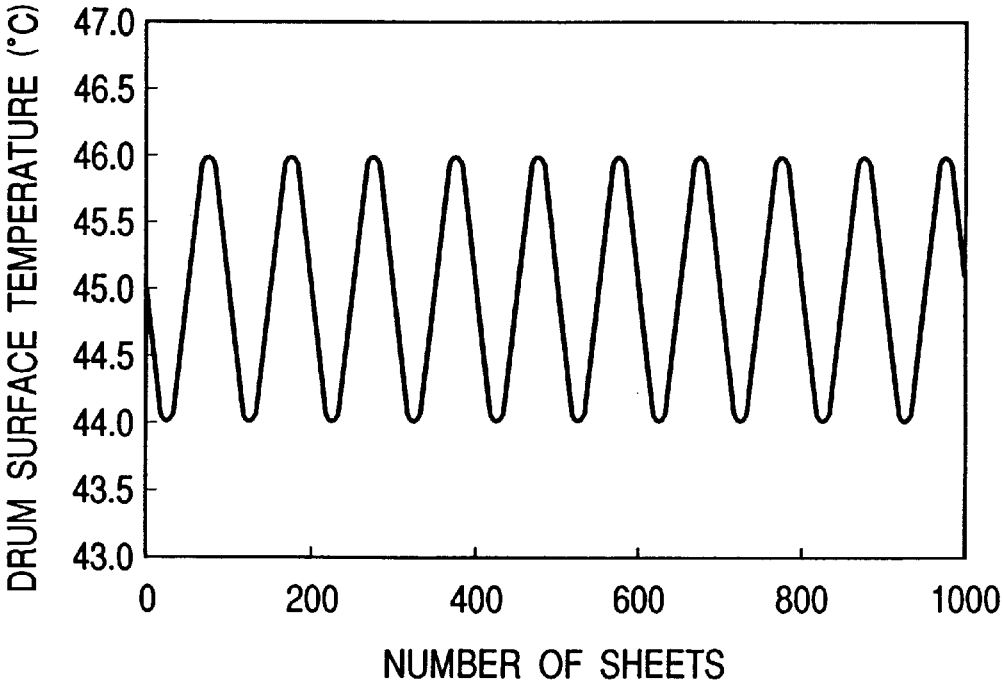

Photosensitive members comprising the conductive substrate with a different thickness and the photoconductive layer with a different thickness were produced by using a temperature control circuit as shown in FIG. 5 and a seamless cylindrical flexible heater adhered to the internal periphery of the photosensitive member. The photosensitive member was set on an experimental equipment, and the power used in Example 3 corresponding to the heat capacity of the photosensitive member was supplied to the heater and was controlled so that the photosensitive member reached 45° C. The temperature variation of the surface of the photosensitive member (drum) was measured with the lapse of time while papers were passed continuously in an environmental temperature of 15° C. The obtained results are shown in FIG. 11 and Table 8.

TABLE 8

Evaluation of variation of drum surface temperature in dynamic state (conventional heater + temperature control circuit)

| | | Thickness of photoconductive layer (μm) | | | | | |
|---|---|---|---|---|---|---|---|
| | | 3 | 5 | 15 | 20 | 35 | 50 |
| Thickness of conductive substrate (mm) | 0.05 | X | X | — | — | — | — |
| | 0.10 | X | X | X | X | X | X |
| | 0.50 | X | X | X | X | X | X |
| | 1.00 | X | X | X | X | X | X |
| | 1.50 | Δ | Δ | Δ | Δ | Δ | Δ |
| | 2.00 | Δ | Δ | Δ | Δ | Δ | Δ |
| | 2.50 | Δ | Δ | Δ | Δ | Δ | Δ |
| | 3.00 | ○ | ○ | ○ | ○ | ○ | ○ |
| | 3.50 | ○ | ○ | ○ | ○ | ○ | ○ |
| | 5.00 | ○ | ○ | ○ | ○ | ○ | ○ |

◎: very good
○: good
Δ: no generation of practical problem
—: not measured

The photosensitive members comprising the substrate of 0.05 mm in thickness showed film peeling at the film deposition or at the measurement because of the insufficient strength of the conductive substrate, so that the measurement was possible only up to the photoconductive layer thickness of 5 μm.

Because a large electric power was supplied in order to compensate the temperature decrease resulting from the paper passing as shown in FIG. 11, there was generated a ripple in the temperature control, thereby leading to an uneven potential and an even image density resulting from this temperature characteristics.

According to the present invention, the thickness of the photoconductive layer is set to be not smaller than 5 μm and smaller than 20 μm to be able to sufficiently suppress the stress in the deposited a-Si(H, X) film, thereby maintaining the peeling thereof at a practically acceptable level or at no film peeling level. Also, the thickness of the drum-shaped metal substrate can be set to not smaller than 0.1 mm and smaller than 2.5 mm, whereby the producing cost can be significantly reduced. Under the above conditions, as the charging device, there can be employed a contact charging device for contacting a charging member with the surface of the photosensitive member and applying a voltage to the charging member to charge the photosensitive member, thereby being able to obtain the potential of a level substantially equal to that in the conventionally used photosensitive member comprising the photoconductive layer with a film thickness of 20 μm or more. It is therefore rendered possible to obtain practically sufficient electrophotographic characteristics and to suppress the disadvantages generated by making a photoconductive layer thinner to a practically acceptable level or to completely eliminate the disadvantages.

Also in the case of using a heater in the drum-shaped metal substrate with a thickness not smaller than 0.1 mm and smaller than 2.5 mm, highly precise temperature control is rendered possible because of the reduced temperature slope between the heater and the surface of the photosensitive member.

Furthermore, the use of a PTC heater with seamless structure makes it possible to supply an electric power far larger than that required for reaching the temperature equilibrium, thereby improving the response and enabling high-speed heating, and to execute the temperature control without overshoot and ripple phenomena even in the dynamic state involving the paper feeding.

What is claimed is:

1. An image forming apparatus comprising:

a cylindrical photosensitive member comprising a conductive substrate having a thickness not smaller than 0.1 mm and smaller than 2.5 mm, and a light-receiving layer having a photoconductive layer on the conductive substrate, the light-receiving layer containing at least amorphous silicon; and a charging device for charging the photosensitive member, wherein the photoconductive layer has a thickness not smaller than 5 μm and smaller than 20 μm, wherein a difference between a most protruding portion and a most recessed portion of the photosensitive member is not more than 30 μm, and wherein the charging device is a device for contacting a charging member with a surface of the photosensitive member and applying a voltage to the charging member to charge the photosensitive member.

2. An image forming apparatus according to claim 1, wherein the photosensitive member has a heater therein, and the heater is composed of a heat-generating resistor with a positive temperature coefficient and is maintained in close contact with an entire internal periphery of the photosensitive member.

3. An image forming apparatus according to claim 1, wherein the conductive substrate is composed of aluminum or an aluminum alloy.

4. An image forming apparatus according to claim 1, wherein the conductive substrate has an external diameter from 20 mm to 60 mm.

5. An image forming apparatus according to any one of claims 1 to 4, wherein a temperature dependency γ of the photosensitive member is $1<\gamma\leqq 6$ at a dark potential and $1<\gamma\leqq 3$ at a light potential.

6. An image forming apparatus according to claim 5, wherein the dark potential is 300V to 500V.

7. An image forming apparatus according to claim 5, wherein the light potential is 50V to 200V.

8. An electrophotographic photosensitive member having a cylindrical shape comprising:

a conductive substrate having a thickness not smaller than 0.1 mm and smaller than 2.5 mm, and a light-receiving layer having a photoconductive layer on the conductive substrate, the light-receiving layer containing at least amorphous silicon, wherein the photoconductive layer has a thickness not smaller than 5 μm and smaller than 20 μm, and wherein a difference between a most protruding portion and a most recessed portion of the photosensitive member is not more than 30 μm.

9. An electrophotographic photosensitive member according to claim 8, wherein the conductive substrate has a cylindrical shape, wherein a heater is provided in an internal space of the conductive substrate adjacent to an interior surface of the conductive substrate, and wherein the heater comprises a heat-generating resistor having a positive temperature coefficient.

10. An electrophotographic photosensitive member according to claim 8 or 9, wherein the conductive substrate comprises aluminum or an aluminum alloy.

11. An electrophotographic photosensitive member according to any one of claim 8 or 9, wherein the conductive substrate has an outside diameter of 20 mm to 60 mm.

12. An electrophotographic photosensitive member according to any one of claims 8 or 9, wherein a temperature dependency $\gamma$ of the photoconductive member is $1<\gamma\leqq 6$ at a dark potential and $1<\gamma\leqq 3$ at a light potential.

13. An electrophotographic photosensitive member according to claim 12, wherein the dark potential is 300V to 500V.

14. An electrophotographic photosensitive member according to claim 12, wherein the light potential is 50V to 200V.

15. An image forming apparatus comprising:

a cylindrical photosensitive member comprising a conductive substrate having a thickness not smaller than 0.1 mm and smaller than 2.5 mm, a light-receiving layer having a photoconductive layer on the conductive substrate, the light-receiving layer containing at least amorphous silicon; and a charging device for charging the photosensitive member, wherein the photoconductive layer has a thickness not smaller than 5 $\mu$m and smaller than 20 $\mu$m, wherein a temperature dependency $\gamma$ of the photosensitive member is $1<\gamma\leqq 6$ at a dark potential and $1<\gamma\leqq 3$ at a light potential, and wherein the charging device is a device for contacting a charging member with a surface of the photosensitive member and applying a voltage to the charging member to charge the photosensitive member.

16. An image forming apparatus according to claim 15, wherein the dark potential is 300V to 500V.

17. An image forming apparatus according to claim 15, wherein the light potential is 50V to 200V.

18. An image forming apparatus according to claim 15, wherein the conductive substrate has a cylindrical shape, wherein a heater is provided in an internal space of the conductive substrate adjacent to an interior surface of the conductive substrate, and wherein the heater comprises a heat-generating resistor having a positive temperature coefficient.

19. An image forming apparatus according to claim 15 or 18, wherein the conductive substrate comprises aluminum or an aluminum alloy.

20. An image forming apparatus according to any one of claims 15 or 18, wherein the conductive substrate has an outside diameter of 20 mm to 60 mm.

21. An electrophotographic photosensitive member having a cylindrical shape comprising:

a conductive substrate having a thickness not smaller than 0.1 mm and smaller than 2.5 mm, and a light-receiving layer having a photoconductive layer on the conductive substrate, the light-receiving layer containing at least amorphous silicon, wherein a photoconductive layer has a thickness not smaller than 5 $\mu$m and smaller than 20 $\mu$m, and wherein a temperature dependency $\gamma$ of the photosensitive member is $1<\gamma\leqq 6$ at a dark potential and $1<\gamma\leqq 3$ at a light potential.

22. An image forming apparatus according to claim 21, wherein the dark potential is 300V to 500V.

23. An image forming apparatus according to claim 21 or 22, wherein the light potential is 50V to 200V.

24. An electrophotographic photosensitive member according to claim 21, wherein the conductive substrate has a cylindrical shape, wherein a heater is provided in an internal space of the conductive substrate adjacent to an interior surface of the conductive substrate, and wherein the heater comprises a heat-generating resistor having a positive temperature coefficient.

25. An electrophotographic photosensitive member according to claim 21 or 24, wherein the conductive substrate comprises aluminum or an aluminum alloy.

26. An electrophotographic photosensitive member according to claim 21 or 24, wherein the conductive substrate has an outside diameter of 20 mm to 60 mm.

* * * * *